US007490439B2

(12) United States Patent
Teramura et al.

(10) Patent No.: US 7,490,439 B2
(45) Date of Patent: Feb. 17, 2009

(54) DOUBLE FLOOR STRUCTURE

(75) Inventors: Akira Teramura, Tokyo (JP); Mitsuru Nakamura, Tokorozawa (JP); Kenji Igarashi, Inzai (JP); Hiroyuki Kishi, Tokyo (JP)

(73) Assignee: Obayashi Corporation, Osaka (JP)

( * ) Notice: Subject to any disclaimer, the term of this patent is extended or adjusted under 35 U.S.C. 154(b) by 658 days.

(21) Appl. No.: 10/503,270

(22) PCT Filed: Jan. 31, 2003

(86) PCT No.: PCT/JP03/01018

§ 371 (c)(1),
(2), (4) Date: Feb. 4, 2005

(87) PCT Pub. No.: WO03/066996

PCT Pub. Date: Aug. 14, 2003

(65) Prior Publication Data

US 2005/0120650 A1 Jun. 9, 2005

(30) Foreign Application Priority Data

Feb. 5, 2002 (JP) ..... 2002-028607

(51) Int. Cl.
*E04B 5/00* (2006.01)

(52) U.S. Cl. ..... 52/126.6; 52/126.7; 52/263; 52/220.5

(58) Field of Classification Search ..... 52/263, 52/126.4, 126.6, 220, 220.5, 220.1, 630, 52/126.1, 126.7, 223.7; 248/916; 454/187
See application file for complete search history.

(56) References Cited

U.S. PATENT DOCUMENTS 3,157,254 A * 11/1964 Spiselman et al. ..... 52/263

(Continued)

FOREIGN PATENT DOCUMENTS

FR 2 724 403 9/1994

(Continued)

OTHER PUBLICATIONS

Korean Office Action issued Mar. 27, 2008 (and an English translation thereof) in Korean application No. 10-2004-7012133, which is a foreign counterpart of the present application.

(Continued)

*Primary Examiner*—Brian E. Glessner
*Assistant Examiner*—Adriana Figueroa
(74) *Attorney, Agent, or Firm*—Wenderoth, Lind & Ponack, L.L.P.

(57) ABSTRACT

An upper floor member 30 unitarily includes a floor panel portion 30*a* for forming a floor surface 12, a first wall portion 30*b* extending downwards from circumferential edges of the floor panel portion 30*a* and continuous in the circumferential direction, and a second wall portion 30*c* spanned between opposed portions of the first wall portion 30*b* and progressively increased in thickness toward the center of the floor panel portion 30*a*. The floor panel portion 30*a* is polygonal in shape, and the first wall portion 30*b* is progressively increased in thickness toward the center of each side. The first wall portion 30*b* extends downwards to the vicinity of the lower floor, and its lower end is supported by a support means 18. Thus, a double floor structure which is inexpensive, has a high stiffness, good workability, and offers a high vibration-damping performance can be provided.

18 Claims, 8 Drawing Sheets

U.S. PATENT DOCUMENTS

| | | | | | |
|---|---|---|---|---|---|
| 3,216,157 | A | * | 11/1965 | Pinter | 52/126.5 |
| 3,324,614 | A | * | 6/1967 | Loewenau | 52/126.6 |
| 3,425,179 | A | * | 2/1969 | Haroldson | 52/283 |
| 3,470,663 | A | * | 10/1969 | Tate | 52/126.6 |
| 3,785,097 | A | * | 1/1974 | Seymour | 52/126.7 |
| 3,938,295 | A | * | 2/1976 | Tate | 52/747.1 |
| 4,074,488 | A | * | 2/1978 | Ray, III | 52/263 |
| 4,438,610 | A | * | 3/1984 | Fifer | 52/263 |
| 4,578,910 | A | * | 4/1986 | Germeroth et al. | 52/105 |
| 4,698,945 | A | | 10/1987 | Munn | |
| 4,825,603 | A | * | 5/1989 | Hardwicke et al. | 52/126.6 |
| D306,350 | S | * | 2/1990 | Hardwicke et al. | D25/138 |
| 4,901,490 | A | * | 2/1990 | Zinniel et al. | 52/263 |
| 4,922,670 | A | * | 5/1990 | Naka et al. | 52/126.6 |
| 5,072,557 | A | * | 12/1991 | Naka et al. | 52/126.6 |
| 5,074,085 | A | * | 12/1991 | Ueda | 52/126.6 |
| 5,228,252 | A | * | 7/1993 | Nehls | 52/126.6 |
| 5,389,737 | A | * | 2/1995 | Kobayashi et al. | 174/483 |
| 5,501,754 | A | * | 3/1996 | Hiraguri | 156/71 |
| 5,791,096 | A | * | 8/1998 | Chen | 52/126.6 |
| 5,904,009 | A | * | 5/1999 | Huang | 52/126.6 |
| 6,024,330 | A | * | 2/2000 | Mroz et al. | 248/188.4 |
| 6,256,952 | B1 | * | 7/2001 | Fahy et al. | 52/263 |
| 6,519,902 | B1 | * | 2/2003 | Scissom | 52/126.4 |
| 2003/0051420 | A1 | * | 3/2003 | Leon | 52/126.6 |
| 2004/0074170 | A1 | * | 4/2004 | Huang | 52/220.1 |
| 2005/0050818 | A1 | * | 3/2005 | Chen et al. | 52/263 |
| 2006/0248814 | A1 | * | 11/2006 | Chen et al. | 52/126.6 |

FOREIGN PATENT DOCUMENTS

| | | | |
|---|---|---|---|
| JP | 60-35708 | | 10/1985 |
| JP | 63-76137 | * | 5/1988 |
| JP | 4-65943 | | 10/1992 |
| JP | 7-132533 | | 5/1995 |
| JP | 2742980 | | 2/1998 |
| JP | 10-169168 | | 6/1998 |
| JP | 10-280654 | | 10/1998 |
| JP | 2001-279914 | | 10/2001 |
| JP | 2002-30725 | | 1/2002 |

OTHER PUBLICATIONS

Japanese Office Action issued Feb. 14, 2008 (and an English translation thereof) in Japanese application No. 2002-028607, which is a foreign counterpart of the present application.

* cited by examiner

DOUBLE FLOOR STRUCTURE

BACKGROUND OF THE INVENTION

The present invention relates to a double floor structure comprising an upper floor supported by a support means provided on a lower floor.

As a general double floor structure, a double floor has been known in which a wiring space for signal cables and power supply cables for OA equipment and the like is provided between two floors, and a double floor structure for a clean room has been known in which an air conditioning chamber is provided under a lower floor and mounting of chips onto a printed substrate or the like is conducted. In these double floor structures, a plurality of round bar steel members having a diameter of about 9 mm and constituting post members at appropriate intervals are erected on the floor surface of the lower floor or on a floor ground member, floor member holding means are fixed to the round bar steel members at positions at a height of 300 to 600 mm from the lower floor, and a floor member is mounted astride the floor member holding means. In this case, the floor member is square in shape, and its four corners are supported by the floor member holding means.

In the mounting of chips onto the printed substrate, an operation of moving a bed with the substrate mounted thereon over a predetermined distance, positioning the bed, and mounting the chips onto the stopped substrate is repeatedly conducted by a mounting device at high speed. In this case, the chips are mounted onto the printed substrate at a pitch of several micrometers, so that a high positioning accuracy is required.

In some cases of the mounting device, the positioning of the substrate, namely, the movement and stoppage of the bed is repeated at a short period of 0.1 sec/cycle, and the bed with the substrate mounted thereon is moved at high speed at the period, so that the device itself constitutes a vibration source. In this case, in the conventional double floor structure, the post members are slender, and the floor member is supported at a high position of the post members, so that stiffness in the vertical direction and horizontal directions is low. Therefore, the vibration by the mounting device is largely amplified, and it takes a long time for the vibration to be damped, so that there is the problem in that the substrate positioning accuracy is lowered and the performance of the mounting device cannot be maintained.

On the other hand, examples of systems having a high stiffness and providing a high vibration-damping performance include a large type surface plate having a weight of about 3.5 to 5 t. The large type surface plate has a structure in which a stainless steel plate having an area of 1200 mm×3000 mm and a thickness of 60 mm, a plate member constructed by winding a stainless steel sheet around a precast concrete having a thickness of 200 mm, or the like is bolted to heavy steel members such as H-shaped steels. Since the surface plate is required to have high horizontalness accuracy at its surface, tremendous time is taken for securing not only the accuracy of the single body but also the horizontalness accuracy at the time of installation, so that the cost rises considerably.

Furthermore, large equipment is required at the time of installing the heavy large type surface plate, and the large equipment cannot be introduced where the installation site is a clean room. Therefore, it is necessary to work with special three-prongs and rollers, so that there is the problem of poor workability.

SUMMARY OF THE INVENTION

The present invention has been made in consideration of the above-mentioned problems in the prior art. Accordingly, it is an object of the present invention to provide a double floor structure that is inexpensive, has a high stiffness, good workability, and offers a high vibration-damping performance.

In order to attain the above object, a double floor structure according to a first aspect of the invention comprising an upper floor member constituting an upper floor, the upper floor member being supported by a support means provided on a lower floor, is characterized in that the upper floor member is unitarily comprised of a floor panel portion forming a floor surface, a first wall portion extending downwards from circumferential edges of the floor panel portion and continuous in the circumferential direction, and a second wall portion spanned between opposed portions of the first wall portion and progressively increased in thickness toward the center of the floor panel portion.

According to such a double floor structure, the floor panel portion forming the floor surface is provided at its circumferential edges with the first wall portion extending downwards and continuous in the circumferential direction, so that high stiffness can be obtained at the circumferential edges of the floor panel portion. Further, since the second wall portion is spanned between opposed portions of the first wall portion and the second wall portion is progressively increased in thickness toward the center of the floor panel portion, namely, in the direction parting away from the circumferential edges, so that an upper floor member with higher stiffness can be formed.

In addition, by providing the wall portions unitary with the floor panel portion on the lower side of the upper floor member, it is possible to provide an extremely high stiffness, as contrasted, for example, to simple reinforcing ribs subsidiarily provided for enhancing the stiffness.

Furthermore, since a simple structure in which the floor panel portion and the wall portions are unitary with each other is adopted, the structure can be cast, resulting in good producibility, and since the structure of the mold is also simple, the floor panel portion and the wall portions can be produced inexpensively.

In addition, the double floor structure according to the present invention is characterized in that the floor panel floor is polygonal in shape, and the first wall portion extending downwards from the sides is progressively increased in thickness toward the center of each of the sides.

That is, although central portions of the first wall portion constituted of a plurality of surfaces tend to be lower in stiffness than the corner portions being the boundaries between the adjacent wall surfaces, the central portions are increased in thickness and, therefore, the stiffness of the first wall portion can be enhanced, and the upper floor member can have higher stiffness.

Furthermore, the polygonal shape is desirably a rectangular shape. That is, the simple shape offers good producibility, and the arrangement of a plurality of the upper floor members can be carried out easily, so that efficient work can be achieved.

In addition, the double floor structure according to the present invention is characterized in that the outer circumferential surface of the first wall portion inclines toward the inside of the upper floor member in the downward direction from the side of the upper floor surface.

That is, in arranging the plurality of upper floor members, the first wall portions of the adjacent upper floor members do not interfere with each other, so that the upper floor members can be laid without gaps therebetween, by abutting the floor panel portions of the adjacent upper floor members each other.

Besides, the double floor structure according to the present invention is characterized in that the first wall portion extends downwards to the vicinity of the lower floor, and their lower ends are each supported by the support means.

Since the upper floor member is supported in the vicinity of the lower floor, even if a horizontal vibration acts thereon, the moment acting on the support means is small. Therefore, the support means would be less liable to be deformed, and can rigidly support the upper floor member, thereby damping the vibration of the upper floor at an early stage.

In addition, the double floor structure according to the present invention is characterized in that the upper floor is formed by arranging a plurality of the upper floor members, and the support means collectively support the first wall portions of the adjacent upper floor members.

Since the first wall portions of the adjacent upper floor members are collectively supported by the common support means, the heights of the portions of the upper floor members adjacently supported by the common support member can be aligned without any adjustment.

The double floor structure according to the present invention is characterized in that the support means is comprised of a rod erected on the lower floor, and an upper floor mount means which is retained to the rod and on which the upper floor member is mounted, the upper floor member comprises a penetration means through which a fixing means for fixing the upper floor member is passed vertically, and the upper floor member is fixed to the upper floor mount means by the fixing means passed through the penetration means.

That is, the upper floor member is fixed to the upper floor mount means retained to the rod erected on the lower floor, by the fixing means passed through the upper floor member, so that the upper floor member can be securely fixed to the lower floor.

Besides, the double floor structure according to the present invention is characterized in that a plurality of the rods for supporting the plurality of the arranged upper floor members are erected on a common base plate disposed on the lower floor. According to this structure, since the plurality of rods for supporting the plurality of upper floor members are erected on the common base plate, the intervals of the rods can be arranged at high accuracy in a factory or the like. Therefore, positioning of the rods at a working site is not needed, so that the double floor can be worked efficiently.

The double floor structure according to the present invention is characterized in that the upper floor mount means is provided with a tapped hole, and a bolt which penetrates through a penetrating hole constituting the penetration means and constitutes the fixing means is fastened into the tapped hole to thereby fix the upper floor member.

That is, the bolt penetrating through the upper floor member is fastened into the tapped hole possessed by the upper floor mount means, to thereby fix the upper floor member, so that the upper floor member can be fixed rigidly.

The double floor structure according to the present invention is characterized in that the upper floor mount means comprises a position adjusting means by which the horizontal position of the tapped hole relative to the rod can be adjusted.

That is, the position of the tapped hole can be adjusted relative to the rod which is fixed, so that it is possible to adjust the positions of the tapped holes according to the bolts penetrating through a plurality of the upper floor members and to easily match the positions of the bolts and the tapped holes, and workability is enhanced.

The double floor structure according to the present invention is characterized in that the upper floor mount means comprises a holding means for holding the upper floor member, the holding means comprises an opening larger than the outer shape of the rod, and the tapped hole, and the position adjusting means is comprised of the holding means with the rod passed through the opening.

That is, the holding means provided with the tapped holes is provided with the opening larger than the outside diameter of the rod, whereby the adjusting means can be provided easily and inexpensively.

The double floor structure according to the present invention is characterized in that the upper floor mount means comprises a vertical movement means engaged with the rod so as to be movable in the vertical direction, and the holding means is mounted on the vertical movement means to thereby constitute a height adjusting means for the upper floor member.

That is, the support means for supporting the upper floor member comprises the height adjusting means, so that a flat floor surface can be easily formed, even in the case of a floor surface formed by arranging a plurality of the upper floor members.

In addition, the double floor structure according to the present invention is characterized in that a screw groove is provided in the outer circumference of the rod, the vertical movement means comprises a screw portion screw-engaged with the screw groove of the rod, and the holding means is engaged and stopped by being clamped between a nut screw-engaged with the rod from the upper side and the vertical movement means.

That is, since the screw groove of the vertical movement means and the screw groove of the rod are screw-engaged with each other, the heights of the holding means and the upper floor member can be easily adjusted by rotating the vertical movement means, and the holding means and the vertical movement means can be fixed securely and firmly by screw-engaging the nut with the rod from the upper side, resulting in that the upper floor member can be supported stably.

The vertical movement means desirably has a hexagonal outer shape in plan view, whereby the vertical movement means can be easily moved by use of a hexagonal wrench or the like.

The vertical movement means is desirably provided in its outer circumferential portion with an opening directed toward the rod, whereby the vertical movement means can be easily moved by inserting a bar or the like into the opening, even in a narrow place into which a wrench or the like cannot be put easily.

A deformation restraining means for supporting the holding means so as to restrain bending deformation of the holding means is desirably provided between the holding means and the lower floor. With the deformation restraining means thus provided, it is possible to restrain the bending deformation of the holding means and to support the upper floor member more stably, whereby a vibration-restraining effect or a vibration-damping performance of the double floor structure can be further enhanced.

Where a plurality of the deformation restraining means are provided and are arranged at regular intervals on a circle with the rod as a center, the bending deformation of the holding means can be effectively restrained, in any direction with the rod as a center.

In addition, it is desirable that a plurality of the deformation restraining means are provided and are disposed on the extension of a line connecting between the rod and the fixing portion for fixation of the fixing means to the holding means. According to this constitution, a downward force exerted on the holding means by the fixing means can be supported by the deformation restraining means and the rod on both sides of the point of application of the force by the fixing means, whereby the bending deformation of the holding means can be restrained more effectively.

The double floor structure according to the present invention is characterized in that the deformation restraining means is comprised of a screw rod, and a nut screw-engaging with the screw rod so as to be movable between the holding means and the lower floor, the holding means comprises a passing hole through which the screw rod is passed, and the holding means is supported by the screw rod passed through the passing hole and the nut screw-engaged with the screw rod, whereby the bending deformation is restrained.

That is, by the simple constitution using the screw rod and the nut, the deformation restraining means can be realized.

The double floor structure according to the present invention is characterized in that one corner portion of the upper floor member disposed at a corner portion of the upper floor is supported by a support means which supports only the upper floor member, and the support member comprises an upper floor member height adjusting means comprised of a corner rod erected on the lower floor, and a corner portion mount means on which the corner portion of the upper floor member is mounted and which is capable of relative movement along the corner rod.

That is, the corner portions of the upper floor formed of a plurality of the floor members are each supported by the support means which singly supports the corner of the upper floor member constituting the corner portion of the upper floor and which comprises the height adjusting means, so that the upper floor thus formed can easily be adjusted to be flat in every nook and corner.

An inner circumferential portion of the corner portion mount means and an outer circumferential portion of the corner rod are provided with screw grooves, and the height adjusting means is constituted by screw engagement between the corner portion mount means and the corner rod, so that it is possible to realize the height adjusting means with a simple constitution even at each corner portion of the upper floor.

The double floor structure according to the present invention is characterized in that the corner rod is provided with a screw hole in the axial direction thereof, and a bolt penetrating through the penetrating hole of the upper floor member and constituting the fixing means is fastened into the screw hole, whereby the upper floor member and the corner portion mount member are fixed.

That is, the bolt penetrating through the upper floor member is fastened into the screw hole provided in the corner rod, whereby the upper floor member and the corner portion mount member can be fixed rigidly.

When the upper floor member is formed of an aluminum material, the upper floor member is light in weight, transportation thereof and the like are easy to carry out, and workability can be enhanced. Furthermore, in cooperation with the simple structure in which the upper portion member is unitarily comprised of the floor panel portion and the wall portions, the upper floor member can be cast, for example, by use of a sandmold, has good producibility, and can be produced inexpensively.

Where the portion member is formed of a damping material, a vibration-restraining effect or a vibration-damping performance of the double floor structure can be further enhanced.

The double floor structure according to the present invention is characterized in that a tension means penetrating through the upper portion members for introduction of a prestress is provided between the adjacent ones of the upper floor members forming the upper floor, and a prestress is introduced in the tension means.

That is, the prestress is introduced into the whole body of the upper floor formed of the plurality of upper floor members, so that the adjacent upper floor members are rigidly jointed to each other, a floor formed of the upper floor members integrated is formed, and it is possible to realize a double floor structure having a high vibration restraining effect or vibration damping performance over the entire body of the floor.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

Now, according to one embodiment of the present invention, a double floor structure for a clean room provided in, for example, a semiconductor manufacturing factory will be described referring to the accompanying drawings.

Figure 1:
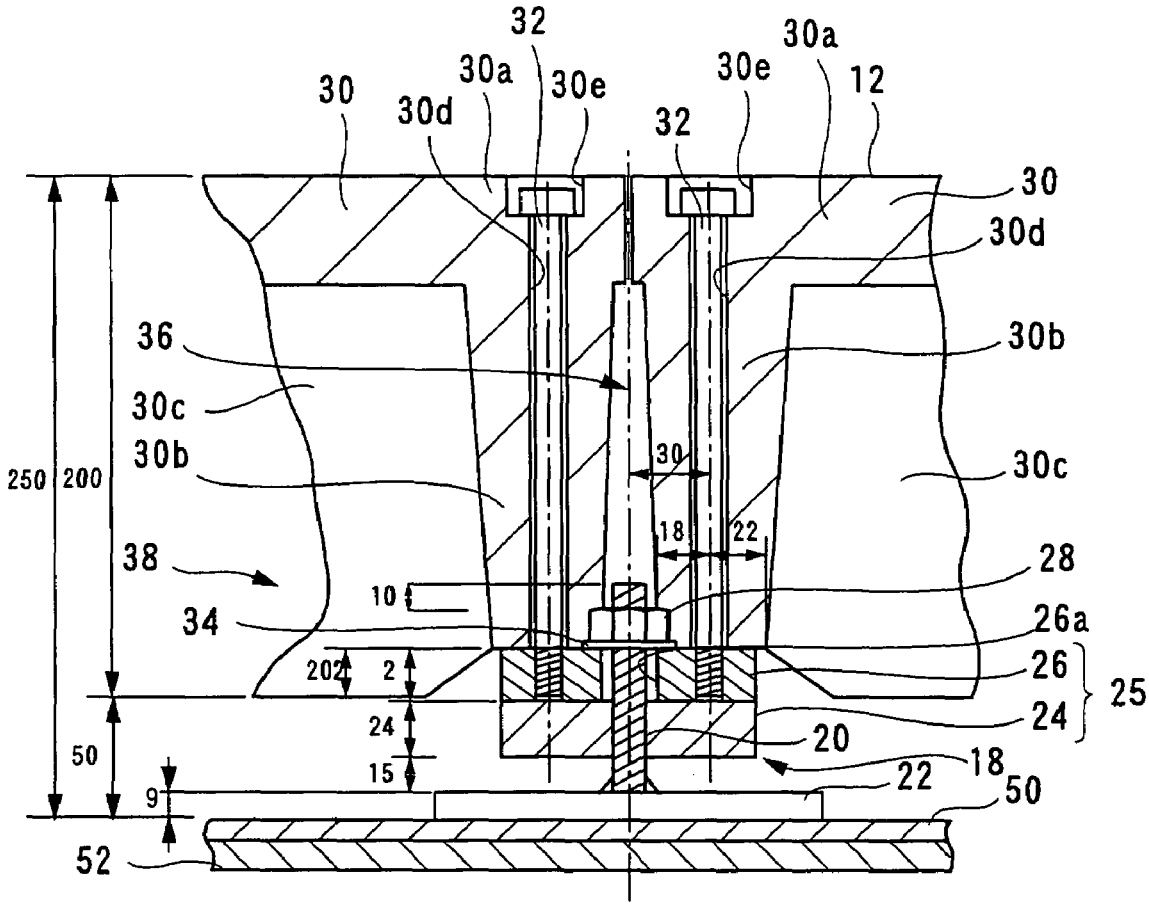
FIG. 1 is a sectional view of a double floor structure according to one embodiment of the present invention.
Figure 2:
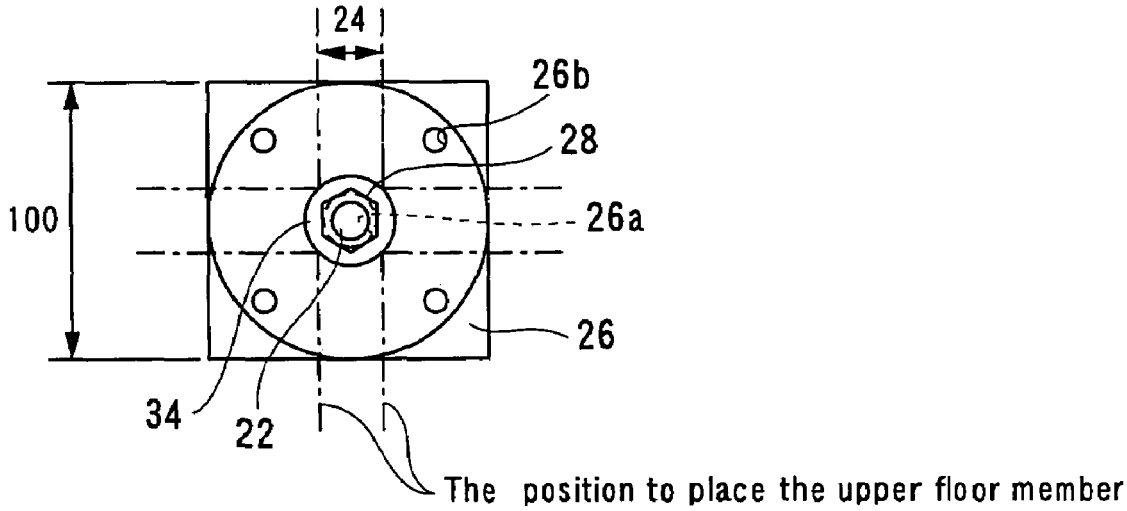
FIG. 2 is a plan view of a seat plate.
Figure 3:
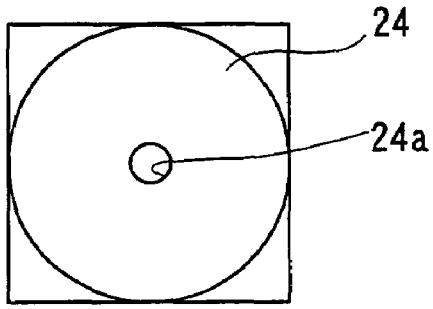
FIG. 3 is a plan view of a height adjusting means.
Figure 4:
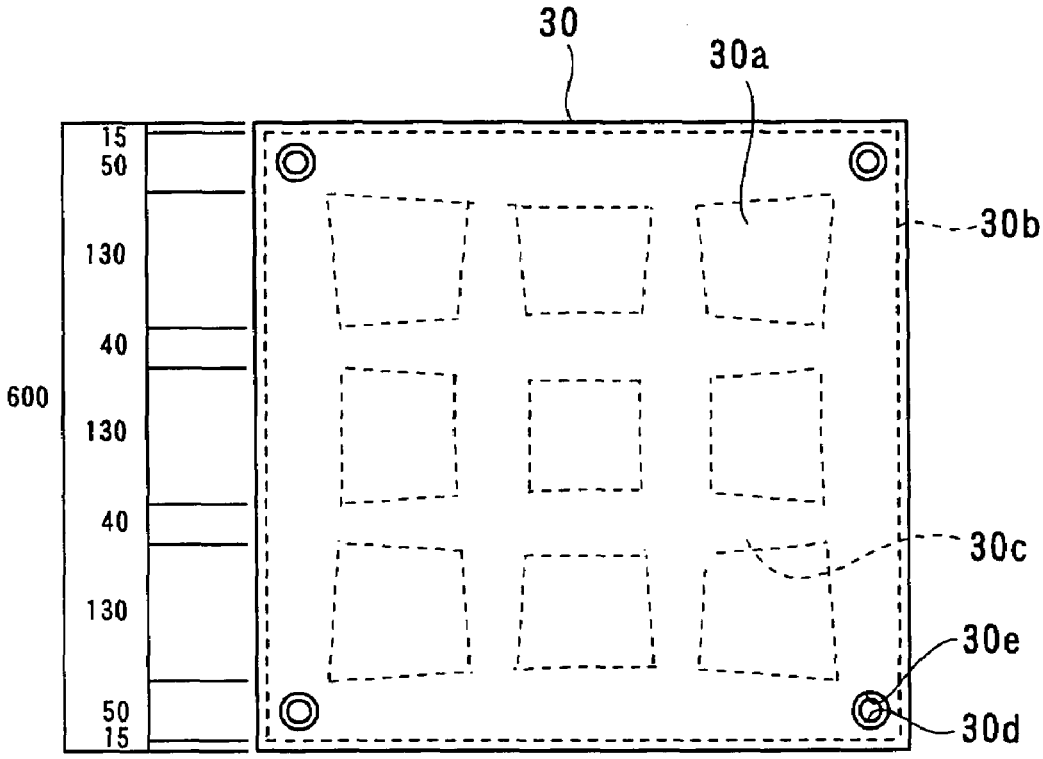
FIG. 4 is a plan view of an upper floor member.
Figure 5:
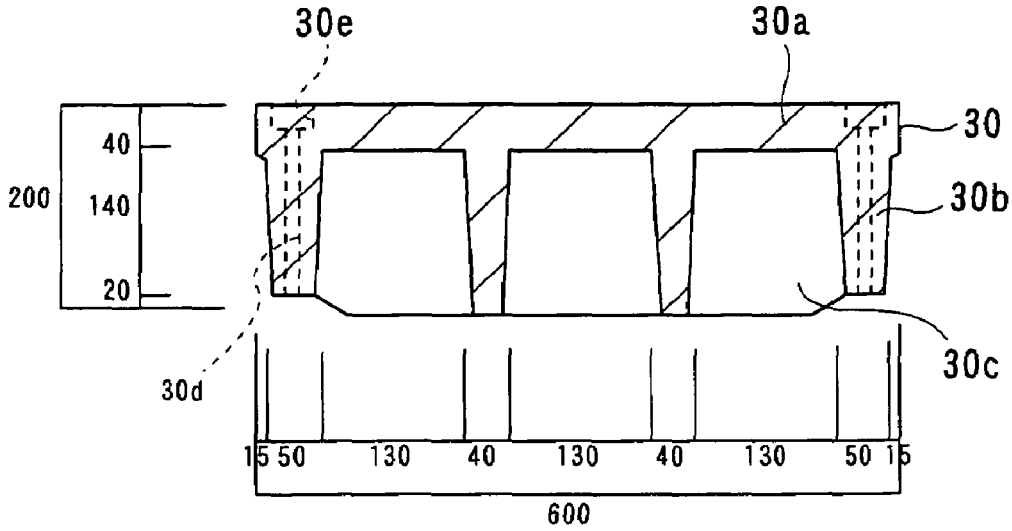
FIG. 5 is a side sectional view of the upper floor member.

FIG. 1 is a sectional view showing one embodiment of the double floor structure according to the present invention. FIG. 2 is a plan view of a seat plate, FIG. 3 is a plan view of a height adjusting plate, FIG. 4 is a plan view of an upper floor member, and FIG. 5 is a side sectional view of the upper floor member.

The clean room to which the double floor structure according to this embodiment is applied is provided with an air conditioning equipment chamber on the lower side of a floor provided in a double form. At an upper portion of the air conditioning equipment chamber, floor joists 52 constituting a floor substrate member are spanned between beams constituting a frame of the clean room at a pitch of about 600 mm, and lower floor members 50 are laid thereon to form the lower floor.

The double floor structure according to this embodiment has a structure in which upper floor members 30 constituting the upper floor have their lower ends supported by support means 18 provided on the floor joists 52 at a pitch of 600 mm. The support means 18 comprises a stud bolt 20 constituting a rod, and a height adjusting plate 24 and a seat plate 26 which constitute an upper floor mount means 25 (i.e. an upper floor mount), and the upper floor member 30 is fixed to the stud bolt 20 through the height adjusting plate 24 and the seat plate 26. In this case, of a plurality of the stud bolts 20 erected at a pitch of 600 mm, four ones constitute a set, and the four corners of the upper floor member 30 measuring 600 mm each side are mounted respectively on the seat plates 26 of four stud bolts 20 arranged at the four corners of a square of □ 600 mm. The corner portions of four upper floor members 30 are mounted on each of the seat plates 26, and the upper floor members 30 are arranged in a matrix form to form an upper floor surface 12.

The upper floor member 30 is made of aluminum, and is unitarily comprised of a floor panel portion 30*a* square-shaped in plan view and having a thickness of about 40 mm, a circumferential wall portion 30*b* constituting a first wall portion extending downwards from circumferential edges of the floor panel portion 30*a* and continuous in the circumferential direction, and intermediate wall portions 30*c* constituting a second wall portion spanning between opposed portions of the circumferential wall portion 30*b* in a lattice form.

The circumferential wall portion 30*b* has its lower end extending downwards to the vicinity of the lower floor, the thickness thereof on the side of an upper end portion is about 50 mm, and the outer circumferential surface is inclined to the inside of the upper floor member 30 in the downward direction. Furthermore, the circumferential wall portion 30*b* is increased in thickness toward the center of each side of the floor panel portion 30*a*, thereby enhancing stiffness.

The intermediate wall portions 30*c* have a height of about 200 mm, and is spanned between opposed portions of the circumferential wall portion 30*b*. Two longitudinal and two crosswise intermediate wall portions 30*c* are provided and arranged at a regular pitch (about 170 mm interval). The intermediate wall portions 30*c* are each increased in thickness toward the center of the floor panel portion 30*a*, namely, in the direction parting away from the circumferential edges, thereby further enhancing the stiffness of the upper floor member 30.

At each of the four corners of the upper floor member 30, a penetrating hole 30*d* is provided and constitutes a penetration means through which a long bolt 32 constituting a fixing means (i.e., a fixing member) for the upper floor member 30 is passed, and a counterbore 30*e* for accommodating a head portion of the long bolt 32 is provided on the side of the floor surface 12.

The support means 18 includes a stud bolt 20 (16 mm in diameter, 90 mm in length) constituting a rod, and an upper floor mount means 25 which is screw-engaged with the stud bolt 20 and on which the upper floor member 30 is mounted.

The stud bolt 20 is erected on a base steel plate 22 (□ 150 mm, 9 mm in thickness) disposed on the upper side of the floor joist 52 and bonded onto the lower floor.

The upper floor mount means 25 includes a height adjusting plate 24 screw-engaged with the stud bolt 20 so as to be movable vertically, and a seat plate 26 mounted on the height adjusting plate 24 and constituting a holding means for the upper floor member 30.

The height adjusting plate 24 is made of a circular disk like steel plate having a diameter of 50 mm and a thickness of 24 mm, and is provided at its center with a tapped hole 24*a* to be screw-engaged with the stud bolt 20.

The seat plate 26 is made of a square aluminum plate having a thickness of 22 mm and a side length of 100 mm, and is provided at its center with a loose hole 26*a* which has a diameter larger than the diameter of the stud bolt 20 and through which the stud bolt 20 penetrates. Between the loose hole 26*a* and the four corner portions of the seat plate 26, fixing holes 26*b* for fixing the upper floor member 30 are provided at roughly middle positions. The fixing holes 26*b* are tapped, and the long bolts 32 penetrating through the upper floor member 30 are fastened into the fixing holes 26*b*, whereby the upper floor member 30 is fixed to the seat plate 26.

The height adjusting plate 24 is screw-engaged with each of the stud bolts 20, and the seat plate 26 is mounted thereon with the stud bolt 20 penetrating through the loose hole 26*a*. Therefore, when the height adjusting plate 24 is rotated, the seat plate 26 and the height adjusting plate 24 are vertically moved along the stud bolt 20.

The corner portions of four different upper floor members 30 are mounted on the respective seat plates 26, and the corner portions of the four adjacent upper floor members 30 abut each other at the center of the seat plate 26 so as to form the floor surface 12.

In addition, since the outer circumferential surface of the circumferential wall portion 30*b* of the upper floor member 30 is inclined toward the inside of the upper floor member in the downward direction as described above, gaps 36 are defined between the circumferential wall portions 30*b* of the upper floor members 30. The stud bolts 20 penetrating through the seat plates 26 project into the gaps 36. A washer 34 sufficiently larger than the loose hole 26*a* is fitted over the stud bolt 20, and a nut 28 is screw-engaged with the stud bolt 20 from the upper side of the washer 34.

That is, the adjustment of height in the present double floor structure is conducted by a method in which the seat plate 26 and the upper floor member 30 are mounted on the height adjusting plate 24 which is screw-engaged with the stud bolt 20 and tentatively fixed at a predetermined height, and when a difference in level of the floor surface 12 is generated between the adjacent upper floor members 30, the height adjusting plates 24 are rotated forwards or reversely to cause such vertical movements that the floor surface 12 becomes flat.

After the floor surface 12 is adjusted to be flat, the nut 28 is fastened to the stud bolt 20, whereby the seat plate 26 is clamped between the height adjusting plate 24 and the nut 28 and is thereby fixed. Thereafter, the four corners of the upper floor member 30 are fixed to the respective seat plates 26 by the long bolts 32. That is, the nut 28 and the height adjusting plate 24 constitute a double nut, whereby the seat plate 26 and the stud bolt 20 are firmly fixed, and the upper floor member 30 can be fixed rigidly. Here, the length of the stud bolt 20 is 90 mm, but since the height adjusting plate 24, the seat plate 26 and the nut 28 are fitted over the stud bolt 20, the length of the portion of the stud bolt 20 projecting to the lower side of the height adjusting plate 24 is about 15 mm. That is, the positions of the height adjusting plate 24 and the seat plate 26 for supporting the upper floor member 30 are set in the vicinity of the lower floor, namely, set at extremely low positions relative to the height of the space defined between the upper and lower floors.

Incidentally, the lengths of the portions of the stud bolt 20 projecting respectively to the lower side of the height adjusting plate 24 and to the upper side of the nut 28 are such lengths that the height adjusting plate 24 can be vertically moved at the time of adjustment of height, and it suffices that these lengths make it possible to accommodate the errors coming from nonlevel of the lower floor surface, erection of the stud bolts 20, working of the height adjusting plates 24 screw-engaged with the stud bolts 20, and the like. Therefore, in order to enhance the vibration damping performance of the floor, it is desirable that the fixing positions of the height adjusting plates 24 and the seat plates 26 be set at lower positions.

Figure 6:
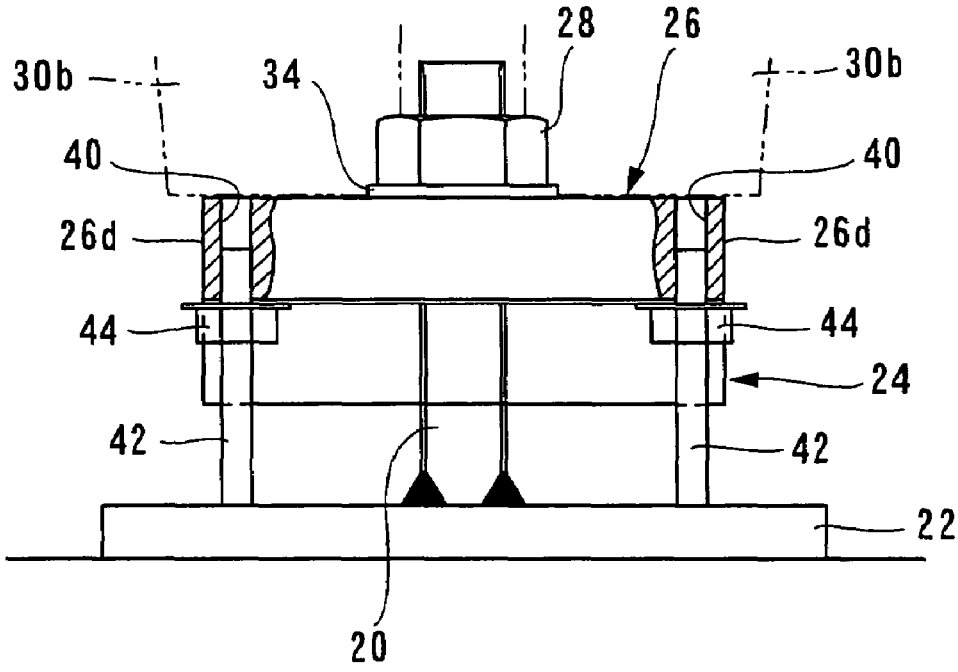
FIG. 6 is a partly broken side view of the surroundings of the seat plate, showing a double floor structure according to a modified embodiment of the present invention.
Figure 7:
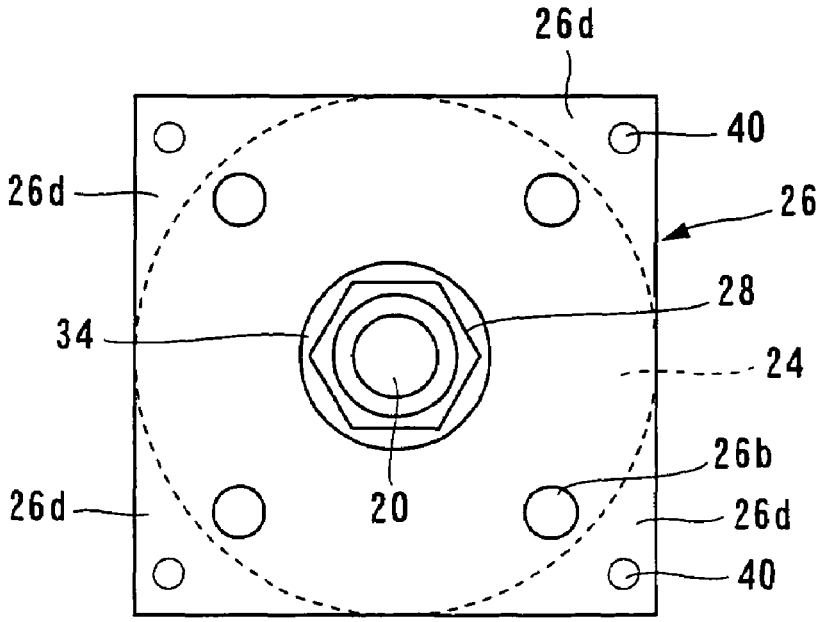
FIG. 7 is a plan view of the surroundings of the seat plate according to the modified example shown in FIG. 6.

FIGS. 6 and 7 show a modified embodiment in which a structure for supporting the seat plate 26 rigidly is added to the above embodiment. Although a sufficient vibration restraining effect or vibration damping performance can be secured in the above-described embodiment, a further vibration restraining effect can be secured in this modified embodiment. The seat plate 26 in the above-described embodiment is laid on the height adjusting plate 24 so as to project farther toward an outer side than the height adjusting plate 24, as seen from FIG. 2. This is arranged so as to ensure that the seat plate 26 is formed with a required minimum plan-view size which enables stable mounting thereon of the circumferential wall portions 30*b* of four upper floor members 30 and fastening of the long bolt 32, thereby securing the flexural rigidity of itself as high as possible, and the height adjusting plate 24 is formed as a circular disk form with a small outside diameter size, thereby securing a flexural rigidity with high isotropy around the stud bolt 20. As a result of adopting such a constitution, the seat plate 26 projects around and to the outer side farther than the height adjusting plate 24, and the projecting portions assume a cantilever form, leading to a lowering of the flexural rigidity, and are liable to undergo a bending deformation. In addition, it is considered that the cantilever form induces free vibration, thereby lowering the vibration restraining effect or vibration damping performance.

In the modified embodiment shown in the figures, a support structure for supporting the projecting portion 26*d* from the base steel plate 22 is provided to enhance the stiffness of the projecting portion 26*d* and restrain the free vibration thereof. To be more specific, this support structure includes a screw hole 40, a screw rod 42 and a nut. The screw hole 40 vertically penetrates each projecting portion 26*d* of the seat plate 26 for mounting the circumferential wall portion 30*b* of the upper floor member 30 thereon. The screw rod 42 acts as a support member whose one end is screw-engaged with the screw hole 40 and whose projection amount from the seat plate 26 can be adjusted so as to bring its other end into contact with the base steel plate 22. The nut 44 is screw-engaged with the screw rod 42 and is pressed against the seat plate 26 by being fastened to the screw rod 42 having its other end brought into contact with the base steel plate 22, so as thereby to firmly press and fix the screw rod 42 to the base steel plate 22.

The support structure is disposed between the base steel plate 22 and the seat plate 26 by a method in which, after the level adjustment by the height adjusting plate 24, the nut 44 is screw-engaged with the screw rod 42 screw-engaged into the screw hole 40 from the upper side of the seat plate 26 and projecting on the lower side of the seat plate 26, thereafter the screw rod 42 is projected out from the screw hole 40 until it comes into contact with the base steel plate 22, and the nut 44 is fastened with the screw rod 42 being in contact with the base steel plate 22. In the modified embodiment as described above, it is possible to firmly and rigidly support the projecting portions 26*d* of the seat plate 26 projecting to the outside of the height adjusting plate 24, to enhance the stiffness of the projecting portions 26*d*, to restrain bending deformation of the seat plate 26, and to restrain the free vibration thereof, thereby further enhancing the vibration restraining effect or vibration damping performance of the double floor structure.

Figure 8A:
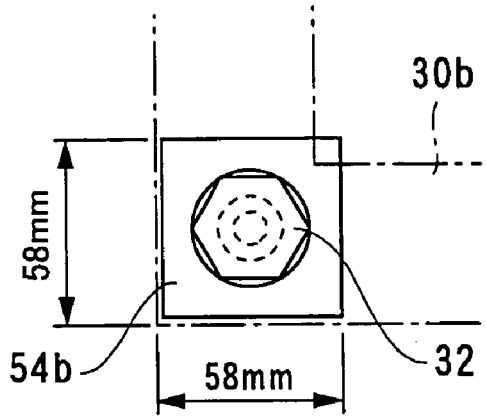
FIG. 8A is a plan view of a support structure at a corner portion of the upper floor.
Figure 8B:
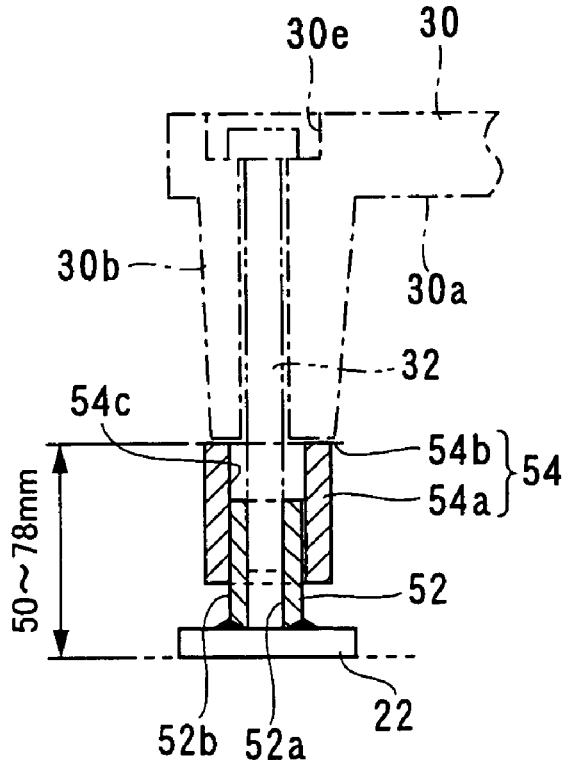
FIG. 8B is a side sectional view of a support structure at a corner portion of the upper floor.

FIG. 8A is a plan view of a support structure at a corner potion of the upper floor, and FIG. 8B is a side sectional view of a support structure at a corner potion of the upper floor. As shown in the figures, one corner portion of the upper floor member 30 disposed at the corner portion of the upper floor is supported by a corner support means 50 which supports only the upper floor member 30. The corner support means 50, in the same manner as the above-mentioned support means 18, includes a corner rod 52 erected on the base steel plate 22 bonded to the lower floor, and a corner portion amount means 54 on which the corner portion of the upper floor member 30 is mounted.

The corner rod 52 is provided in its outer circumferential portion with a screw groove 52*b*, and is provided at its center with a screw hole 52*a* for fixing the upper floor member 30 in the axial direction thereof. The corner portion mount means 54 includes a corner mount portion 54*a* and a mount plate 54*b*. The corner mount portion 54*a* has a cylindrical form, is provided in its inner circumferential portion with a screw groove 54*c* and is screw-engaged with the outer circumferential portion of the corner rod 52. The mount plate 54*b* is provided at the upper end of the corner mount portion 54*a* so as to stably mount the upper floor member 30 on the corner mount portion 54*a*.

The corner support means 50 is so constructed that by rotating the corner mount means 54 screw-engaged with the corner rod 52, the corner mount means 54 is moved vertically, whereby the height of the upper floor member 30 mounted on the mount plate 54*b* can be adjusted.

In addition, the upper floor member 30 mounted on the corner mount means 54 is rigidly fixed to the corner rod 52 together with the corner mount means 54 by a method in which the long bolt 32 penetrating through the penetrating hole 30*d* of the upper floor member 30 is fastened into the screw hole 52*a* to thereby press the lower end of the circumferential wall portion 30*b* against the mount plate 54*b*.

Figure 9:
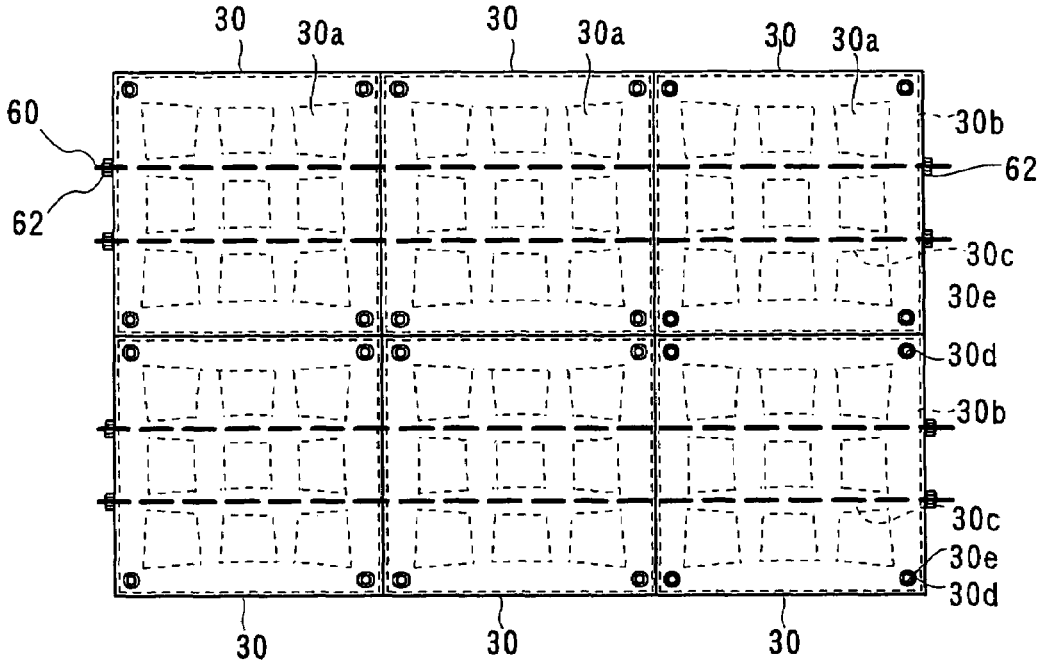
FIG. 9 is an illustration of an example of fixing the adjacent upper floor members together by introducing a prestress therein.

FIG. 9 is an illustration of an example of fixing the adjacent upper floor members 30 together by introducing a prestress therein. As shown in the figure, of the plurality of upper floor members 30 arranged, the adjacent upper floor members 30 are provided with communicating holes penetrating therethrough, and prestress introducing steel bars 60, wires or the like having screw portions at their end portions are passed through the holes. Both end portions of the steel bars 60 or the like thus passed are projected from the upper floor members 30 located at end portions of the upper floor. When tensile forces are introduced into the steel bars 60 or the like, prestresses are introduced therein by fastening nuts 62 onto the screw portions of the projecting end portions of the steel bars 60 or the like, and the steel bars 60 or the like are fixed in this condition, it is possible to further enhance the stiffness of the structure of the upper floor, and to further enhance the vibration restraining effect or vibration damping performance.

According to the above-described embodiment, the upper floor member 30 has the lower end of the circumferential wall portion 30*b* thereof mounted on the seat plate 26, and the seat plate 26 is fixed to the stud bolt 20 in the vicinity of the lower floor. Therefore, the moment acting on the lower end of the stud bolt 20 is small even when horizontal vibration acts on the floor, so that the stud bolts 20 would be less liable to be deformed, the stiffness of the upper floor members 30 and of the floor as a whole can be enhanced, and the vibration of a device mounted on the floor can thereby be damped at an early stage.

In addition, the upper floor member 30 unitarily comprises the circumferential wall portion 30*b* provided along the entire circumference thereof, and the intermediate wall portion 30*c*, whereby the upper floor member 30 can be provided with high stiffness and strength even where the upper floor member 30 is formed of a light material of aluminum and the material is partly removed. Therefore, the upper floor members 30 can be easily transported to the working site and worked, without using heavy-duty equipment or special equipment as in the case of the conventional large type surface plate.

Furthermore, the upper floor member 30 has an aluminum-made simple structure, and is formed in a small size in a square shape with each side measuring 600 mm. Therefore, the upper floor members 30 can be produced by casting with the use of a sand mold. Further, the stud bolts 20 high in versatility are used as the post members. Therefore, the double floor structure can be realized extremely inexpensively.

While the shape of the floor panel portion 30*a* has been square in the above-described embodiment, other shapes, for example, polygonal shapes such as a rectangular shape, a triangular shape and a hexagonal shape may be adopted, and a combination of these shapes may also be adopted to arrange the upper floor members 30 all over the floor.

While the upper floor members 30 have been described as being made of aluminum as an example in the above-described embodiment, the upper floor members 30 may be formed by use of a known light-weight damping material such as damping steel or damping alloys as a material. Even in the cases of such damping materials, the upper floor members 30 can be formed in the same manner as in the case of aluminum, and a better vibration restraining effect or vibration damping performance can be thereby secured.

Figure 10:
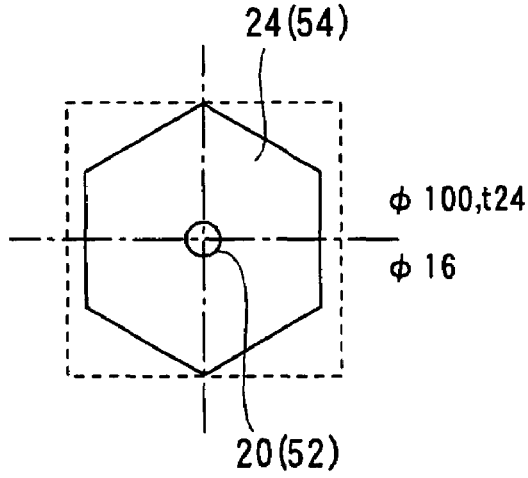
FIG. 10 is an illustration of the case where the outer shapes of the height adjusting plate and the corner mount means are hexagonal in plan view.
Figure 11:
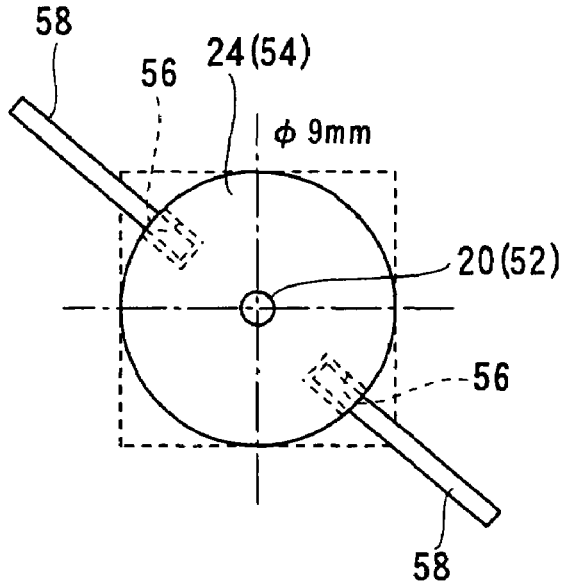
FIG. 11 is an illustration of the case where the height adjusting plate and the corner mount means are provided with an opening directed toward the stud bolt or the corner rod.

Besides, when the outside shapes of the height adjusting plate 24 and the corner mount portion 54 are hexagonal in plan view as shown in FIG. 10 or when the outer circumferential portions thereof are provided with openings 56 directed toward the stud bolt 20 or the corner rod 50 as shown in FIG. 11 so that steel bars 58 or the like can be inserted into the openings 56, it is possible to easily rotate the height adjusting plate 24 and the corner mount portion 54 to thereby achieve vertical movements, whereby height adjustment is facilitated.

Figure 12:
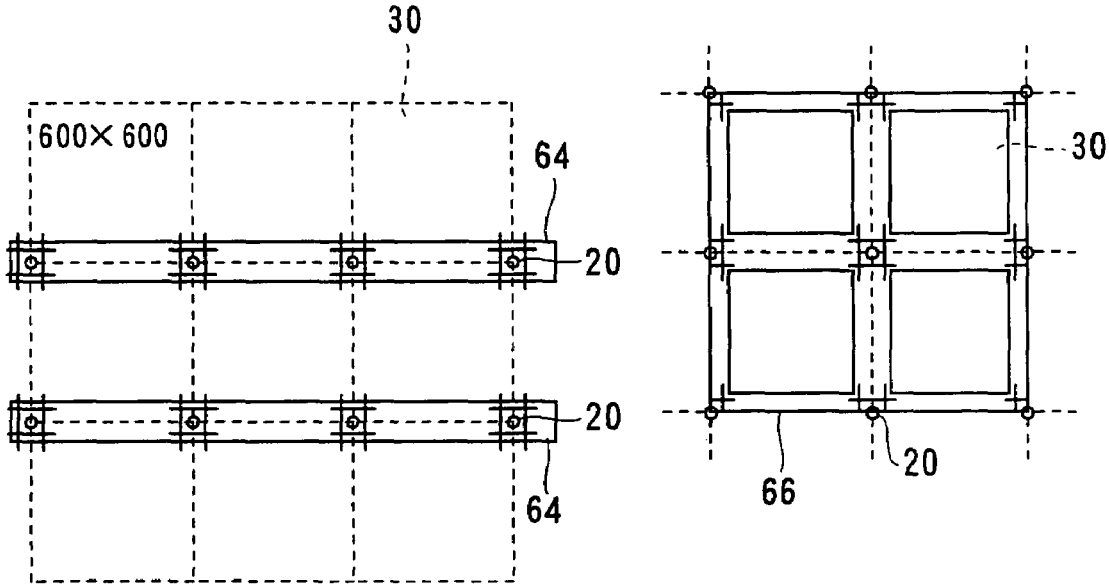
FIG. 12 is an illustration showing an example in which a plurality of rods for supporting a plurality of upper floor members are erected on a common base plate.

In addition, while an example in which the stud bolts 20 and the corner rods 52 are erected respectively on separate base steel plates 22 has been shown in the above-described embodiment, a multiplicity of stud bolts 20 and corner rods 52 may be erected on an elongate steel plate 64 capable of mounting a plurality of upper floor members 30 thereon or a lattice form steel plate 66, as shown in FIG. 12. In that case, the stud bolts 20 and the like can be preliminarily erected on the elongate steel plates 64 or the lattice form steel plate 66, at a factory or the like. Thus, the stud bolts and the like can be erected at accurate positions, and positioning of the stud bolts and the like at the site becomes unnecessary, so that efficient working can be realized.

Besides, while an example in which a penetrating hole is provided in the upper floor member as the penetration means has been shown in the above-described embodiment, a constitution may be adopted in which a cylindrical or columnar resin, rubber or the like is integrally provided so as to vertically penetrate through the upper floor member 30, a tapping screw or the like of the type of fastening while tapping by itself is used as the fixing means at the portion of the resin or rubber, and this is screw-engaged directly with the seat plate or the like.

As has been described above, at the floor panel portion for forming the floor surface, the first wall portion extending downwards from the circumferential edges thereof is continuous in the circumferential direction, and the second wall portion spanned between and integral with opposed portions of the first wall portion is progressively increased in thickness toward the center of the floor panel portion. Therefore, the upper floor member can be provided with extremely high stiffness. Further, since the upper floor member has a simple structure, the upper floor members can be produced inexpensively.

In addition, each central portion of the first wall portion comprised of a plurality of surfaces is increased in thickness, whereby the upper floor member can be provided with higher stiffness. Further, if the floor panel portion is rectangular, producibility thereof is enhanced, and since it is easy to arrange a plurality of the upper floor members at the time of arranging them, workability is enhanced.

Besides, the outer circumferential surface of the first wall portion is inclined toward the inside of the upper floor member in the downward direction, so that the upper floor members can be arranged all over the floor without generating gaps, by abutting the floor panel portions of the adjacent upper floor members each other.

In addition, since the first wall portion is extended downward to the vicinity of the lower floor and its lower end is supported in the vicinity of the lower floor, the support means would be less liable to be deformed even when horizontal vibration acts. Therefore, the upper floor members can be supported rigidly, and vibration of the upper floor can be damped early.

Besides, since the upper floor is formed by arranging a plurality of upper floor members and the first wall portions of the adjacent upper floor members are collectively supported by the support means, it is easy to align the heights of the portions of the adjacent upper floor members.

In addition, since the upper floor member is fixed to the upper floor mount means retained to the rod erected to the lower floor, by the fixing means penetrating through the upper floor member, the upper floor members can be securely fixed to the lower floor.

Besides, when a plurality of rods for supporting a plurality of upper floor members are erected on a common base plate, it is unnecessary to position the rods at a working site, and the double floor can be worked efficiently.

Since the upper floor member is fixed by fastening the bolt penetrating through the upper floor member into the tapped hole possessed by the upper floor mount means, the upper floor member can be fixed rigidly.

Since the upper floor mount means comprises the position adjusting means, the positions of the bolts penetrating through the plurality of upper floor members and the tapped holes can be easily matched to each other, and workability is enhanced.

Further, the position adjusting means can be provided easily and inexpensively, by providing the holding means with the opening larger than the outside diameter of the rod.

Since the support means for supporting the upper floor member comprises the height adjusting means, a flat floor surface can be easily formed, even where the floor surface is formed by arranging a plurality of the upper floor members.

In addition, since the screw groove of the vertical movement means and the screw groove of the rod are screw-engaged with each other, height adjustment can be easily achieved by rotating the vertical movement means, and the upper floor member can be supported stably, by fixing the holding means and the vertical movement means securely and firmly.

When the vertical movement means has a hexagonal outer shape in plan view or is provided at its outer circumferential portion with the opening directed toward the rod, the vertical movement means can be moved easily.

Besides, by providing the deformation restraining means for supporting the holding means so as to restrain bending deformation of the holding means, the upper floor member can be supported more stably, and the vibration restraining effect or vibration damping performance of the double floor structure can be further enhanced.

Since the plurality of deformation restraining means are disposed at regular intervals on a circle centering on the rod, the bending deformation of the holding means can be restrained effectively.

In addition, since the plurality of deformation restraining means are disposed on the extension of a line connecting between the rod and the fixing portion for fixation of the fixing means to the holding means, the holding means can be supported by the deformation restraining means and the rod on both sides of the point of application of the force by the fixing means, and the bending deformation of the holding means can be restrained further effectively.

Since the deformation restraining means includes the screw rod and the nut screw-engaged with the screw rod, deformation of the holding means can be restrained by a simple constitution.

Since the corner portions of the upper floor formed of a plurality of floor members are each supported singly and the height adjusting means are provided, the upper floor can be adjusted to be flat in every nook and corner.

Besides, the inner circumferential portion of the corner portion mount means and the outer circumferential portion of the corner rod are screw-engaged with each other, a height adjusting means can be realized by a simple constitution.

Since the corner portions of the upper floor member are each fixed by fastening the bolt constituting the fixing means into the screw hole of the corner rod, the upper floor member and the corner portion mount member can be fixed rigidly.

When the upper floor members are formed of aluminum, producibility is enhanced, the upper floor members can be produced inexpensively, and workability is enhanced.

When the upper floor members are formed of a damping material, the vibration restraining effect or vibration damping performance of the double floor structure can be further enhanced.

Besides, since a tension means for introduction of prestress which penetrates through the upper floor members is provided between the adjacent upper floor members and a prestress is introduced in the tension means, it is possible to realize a double floor structure having a high vibration restraining effect or vibration damping performance throughout the floor.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A double floor structure comprising:

an upper floor comprising a plurality of upper floor members;

a lower floor;

a plurality of rods for supporting said plurality of upper floor members, said plurality of rods being erected on a common base plate disposed on said lower floor; and upper floor mounts connected to said rods, respectively, said upper floor being mounted on said upper floor mounts, wherein each of said upper floor members includes a floor panel portion for forming a floor surface, a first wall portion extending downwards from circumferential sides of said floor panel portion and extending continuously in a circumferential direction, and a second wall portion spanned between opposed portions of said first wall portion and progressively increased in thickness toward a center of said floor panel portion, said floor panel portion, said first wall portion and said second wall portion being formed unitarily, each of said upper floor members including a penetration means and being fixed to at least one of said upper floor mounts by a fixing member penetrating through said penetration means, wherein each of said upper floor mounts comprises a tapped hole, wherein said fixing member comprises a bolt and said penetration means comprises a penetrating hole, and wherein each of said upper floor members is fixed to said at least one of said upper floor mounts by said bolt penetrating through said penetrating hole and being fastened into said tapped hole, wherein each of said upper floor mounts comprises a holding means for holding at least one of said upper floor members, said holding means including an opening larger than an outer shape of a respective one of said rods, and including said tapped hole, wherein a deformation restraining means for supporting said holding means so as to restrain bending deformation of said holding means is provided between said holding means and said lower floor, and wherein said deformation restraining means includes a screw rod, and a nut screw-engaged with said screw rod so as to be movable between said holding means and said lower floor, said holding means comprises a passing hole through which said screw rod is passed, and said holding means is supported by said screw rod passed through said passing hole and said nut screw-engaged with said screw rod, whereby said bending deformation is restrained.

2. A double floor structure as set forth in claim 1, wherein said floor panel portion is polygonal in shape, and said first wall portion extending downwards from circumferential sides of said floor panel portion is progressively increased in thickness toward a center of each of said circumferential sides.

3. A double floor structure as set forth in claim 2, wherein said polygonal shape is a rectangular shape.

4. A double floor structure as set forth in claim 1, wherein an outer circumferential surface of said first wall portion inclines toward an inside of a corresponding upper floor member in a downward direction from a side of said upper floor surface.

5. A double floor structure as set forth in claim 1, wherein said first wall portion extends downwards to a vicinity of said lower floor, and a lower end of said first wall portion is supported by at least one of said upper floor mounts.

6. A double floor structure as set forth in claim 1, wherein said rods and said upper floor mounts collectively support first wall portions of adjacent ones of said upper floor members.

7. A double floor structure as set forth in claim 1, wherein each of said upper floor mounts comprises a vertical movement means engaged with said respective one of said rods so as to be movable in a vertical direction, and said holding means is mounted on said vertical movement means such that a height of said at least one of said upper floor members is adjustable.

8. A double floor structure as set forth in claim 7, wherein a screw groove is provided in an outer circumference of each of said rods, said vertical movement means is provided with a screw portion for screw engagement with said screw groove of said respective one of said rods, and said holding means is retained by being clamped between a nut screw engaged with said respective one of said rods from an upper side and said vertical movement means.

9. A double floor structure as set forth in claim 7, wherein said vertical movement means has a hexagonal outer shape in a plan view.

10. A double floor structure as set forth in claim 7, wherein said vertical movement means is provided with an opening in an outer circumferential portion of said vertical movement means, said opening being directed toward said respective one of said rods.

11. A double floor structure as set forth in claim 1, wherein said deformation restraining means comprises a plurality of deformation restraining means arranged at regular intervals on a circle centering on said respective one of said rods.

12. A double floor structure as set forth in claim 1, wherein said deformation restraining means comprises a plurality of deformation restraining means arranged on an extension of a line along a surface of said holding means connecting between said respective one of said rods and said tapped hole.

13. A double floor structure as set forth in claim 1, wherein at least one of said upper floor members is disposed at a corner portion of said upper floor, and a corner portion of said at least one of said upper floor members is supported by a corner support which supports only said at least one of said upper floor members, and said corner support comprises a corner rod erected on said lower floor, and a corner portion mount on which said corner portion of said at least one of said upper floor members is mounted and which is capable of relative movement along said corner rod so as to adjust a height of said at least one of said upper floor members.

14. A double floor structure as set forth in claim 13, wherein an inner circumferential portion of said corner portion mount and an outer circumferential portion of said corner rod are provided with screw grooves, and the height of said at least one of said upper floor members is adjustable by screw engagement between said corner portion mount and said corner rod.

15. A double floor structure as set forth in claim 13, wherein said corner rod is provided with a screw hole in an axial direction thereof, said bolt being fastened into said screw hole, whereby said at least one of said upper floor members and said corner portion mount are fixed.

16. A double floor structure as set forth in claim 1, wherein said upper floor members are formed of an aluminum material.

17. A double floor structure as set forth in claim 1, wherein said upper floor members are formed of a damping material.

18. A double floor structure as set forth in claim 1, wherein a tension means for penetrating through said upper floor members for introduction of a prestress is provided between adjacent ones of said upper floor members constituting said upper floor, and a prestress is introduced in said tension means.

* * * * *